US007681722B2

(12) United States Patent
Buchter et al.

(10) Patent No.: US 7,681,722 B2
(45) Date of Patent: Mar. 23, 2010

(54) NEEDLE HOLDER

(75) Inventors: Mark S. Buchter, Orange, CT (US); Andrew J. Vacco, Wallingford, CT (US)

(73) Assignee: Tyco Healthcare Group LP, North Haven, CT (US)

( * ) Notice: Subject to any disclaimer, the term of this patent is extended or adjusted under 35 U.S.C. 154(b) by 854 days.

(21) Appl. No.: 11/363,761

(22) Filed: Feb. 28, 2006

(65) Prior Publication Data

US 2008/0011633 A1 Jan. 17, 2008

(51) Int. Cl.
*B65D 85/24* (2006.01)

(52) U.S. Cl. ..... 206/63.3; 206/366; 206/380

(58) Field of Classification Search ..... 206/339, 206/340, 365, 366, 369, 370, 380–383, 63.3; 53/473, 475; 211/85.13, 195; 604/110, 192; 24/707.1, 707.2, 707.4, 707.5; 248/547
See application file for complete search history.

(56) References Cited

U.S. PATENT DOCUMENTS

| | | | | |
|---|---|---|---|---|
| 279,075 | A | 6/1883 | Berry | |
| 5,155,943 | A | 10/1992 | Matsutani et al. | |
| 5,450,739 | A | 9/1995 | Bogart et al. | |
| 5,542,523 | A | 8/1996 | Abbate et al. | |
| 5,584,809 | A * | 12/1996 | Gaba | 604/110 |
| 5,603,419 | A * | 2/1997 | Peterson | 211/195 |
| 5,630,268 | A | 5/1997 | Smith et al. | |
| 5,902,320 | A | 5/1999 | Matsutani et al. | |
| 6,280,419 | B1 * | 8/2001 | Vojtasek | 604/192 |
| 6,382,417 | B2 * | 5/2002 | Kanner et al. | 206/366 |
| 2005/0182362 | A1 * | 8/2005 | Sircom et al. | 604/110 |

FOREIGN PATENT DOCUMENTS

| | | |
|---|---|---|
| DE | 197 07 567 | 8/1998 |
| DE | 200 10 952 | 10/2000 |
| DE | 101 58 948 | 6/2003 |
| DE | 103 27 067 | 1/2005 |
| EP | 0 619 983 | 10/1994 |
| EP | 0 642 887 | 3/1995 |
| EP | 0 924 799 | 6/1999 |
| GB | 2 006 063 | 5/1979 |

OTHER PUBLICATIONS

European Search Report for EP 07004024.1-2302 date of completion is May 10, 2007 (8 pages).

* cited by examiner

*Primary Examiner*—Luan K Bui

(57) ABSTRACT

A needle holder that includes a fixed support member having an aperture therethrough, and a movable holding member mounted to the fixed member. The movable holding member contains a slot for receiving a needle and is movable between a first needle blank receiving position which enables receipt of said needle blank within said slot and a second needle blank holding position wherein the needle blank is held against the fixed support member.

18 Claims, 5 Drawing Sheets

NEEDLE HOLDER

BACKGROUND

1. Technical Field

The present disclosure relates to needle stock holders and, more particularly, to needle holders that are used to manufacture surgical needles.

2. Background of Related Art

Processes and equipment for manufacturing surgical needles are well known in the art. Conventionally, wire on spools is straightened and cut into needle blanks. The needle blanks are then subjected to a series of conventional grinding, forming, shaping and drilling steps to form surgical needles having distal piercing points and proximal suture mounting ends. The distal ends of the needles may be either of the taper point type or the cutting edge type. The suture mounting end may have a formed channel or a drilled hole. The needles may have piercing points that are sharp or blunt and the body of the needles may be straight or curved.

Straight needles are typically used to suture easily accessible tissue that can be manipulated directly by hand. The straight-body needle is also useful in microsurgery for nerve and vessel repair. Examples of straight-body needles include the Keith needle, which is a straight cutting needle used for skin closure of abdominal wounds, and the Bunnell needle, which is used for tendon/GI tract repair.

Curved needles offer a predictable path through tissue and require less space for maneuvering than a straight needle. The semicircular path is the optimal course for sutures through tissue and provides an even distribution of tension. Common body curvature of the needle is a quarter-inch, three-eighths-inch, half-inch, or five-eighths-inch circle. The three-eighths-inch circle is used most commonly for skin closure. The half-inch circle was designed for confined spaces, and more manipulation by the surgeon is required (i.e., increased wrist motion is required). Additionally, curved needles are also specifically designed for ophthalmic surgery.

Most surgical needles are typically made one at a time. However, it is increasingly difficult to maintain the precision quality of very small needles, e.g. needles used in microscopic surgery, such as ophthalmic needles. Each needle must be cut, formed and sharpened, in order to yield uniform surgical needles.

It is typically required that conventional surgical needles have a smooth surface free from burrs, protrusions, machining marks, and other known surface irregularities. Such protrusions or surface irregularities may result from the needle manufacturing process and should be removed from the needle in order to have a needle with a smooth surface. This smooth surface provides minimal tissue drag and decreased tissue trauma. A variety of methods for providing needles free from protrusions and surface irregularities are known in the art and a particularly useful method involves electropolishing. See, e.g., U.S. Pat. Nos. 5,762,811 and 5,693,454 owned by Tyco Healthcare of Mansfield, Mass.

Although the electropolishing processes of the prior art for surgical needles are adequate, there are certain disadvantages attendant with their use. Most conventional electropolishing processes are batch processes. Wherein, mechanical damage may result from the needles coming into contact with each other during handling and processing. Also, during the batch electropolishing processes excess metal is removed from the needle and the metal removal rate is highly variable and not specific to a certain part of the needle such as the tip, body or mounting end. In these processes it is difficult to polish specific sections of a needle without polishing the entire needle.

Another disadvantage is that the needles may experience different removal rates depending on their location within the bath with respect to the electrodes and with respect to the other needles.

Therefore, it is desirable to have a device for holding needles in a position separate from each other while they are manufactured. Further, it is desirable to have a device for holding needles that maintains the needles horizontally aligned in the same plane so that each of the specific needle parts can be exposed to a certain step of the manufacturing process for the same length of time and/or for the same portions of the needle.

SUMMARY

Accordingly, a needle holder in accordance with the present disclosure includes a fixed support member defining an aperture therethrough, and a movable holding member having a slot therein for receiving at least a portion of a needle blank, wherein the movable holding member is mounted to the fixed support member for movement relative to the aperture to expose the slot for receiving the needle blank. While the slot is exposed and the needle blank is inserted therethrough, the movable holding member retracts from a first needle receiving position into a second needle holding position wherein the needle is held against the fixed support member.

In another embodiment, a needle holder in accordance with the present disclosure may also include a vertical support member. The vertical support member is in abutting relationship with the fixed support member proximal to the aperture for vertically supporting the needle after passing through the slot on the movable holding member. The vertical support member, therefore, provides a base upon which the needle blank can be vertically supported.

In yet another embodiment, a needle holder in accordance with the present disclosure may further include an array of holders horizontally aligned in the same plane, wherein each holder includes a fixed support member, and a movable holding member. The fixed support member defining an aperture therethrough and the movable holding member having a slot therein for receiving at least a portion of a needle blank therein, and mounted to the fixed support member for movement relative to the aperture to expose the slot for receiving the needle blank. While the slot is exposed, the needle blank is inserted therethrough and the movable holding member retracts from a first needle receiving position into a second needle holding position wherein the needle is held against the fixed support member.

BRIEF DESCRIPTION OF THE DRAWNGS

Various embodiments are described herein with reference to the drawings wherein.

DETAILED DESCRIPTION

Figure 3:
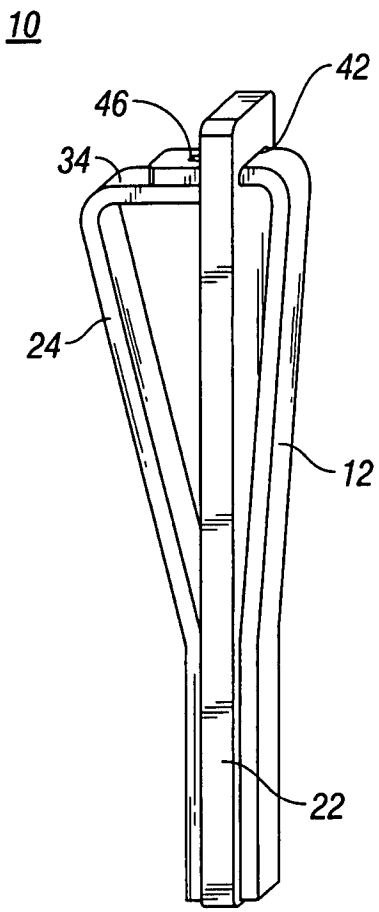
FIG. 3 is perspective view of a needle holder in a needle receiving position with an inward force applied to the movable holding member.

Referring now to FIGS. 1-10 there is shown a needle holder 10 having a proximal and a distal end. The term "proximal" will refer to the end of the needle holder 10 which is closer to base 50, while the term "distal" will refer to the end which is further from base 50.

A needle holder 10 as described herein includes fixed support member 22 and a movable holding member 12 which is selectively biasable into a needle holding position wherein needle 15 is held against fixed support member 22. For example, movable holding member 12 may be positioned to include a portion which is cantilevered or be configured as a leaf spring which biases the movable holding member 12 into the needle holding position. Movable holding member 12 is mounted to fixed support member 22 and includes slot 46 which is defined therein and configured to receive needle 15. Fixed support member 22 has aperture 42 defined therethrough to receive movable holding member 12 upon inward movement thereof and configured to provide frictional support when needle 15 is situated and held within slot 46 located on movable holding member 12.

In one embodiment, slot 46 is formed on the distal side of movable holding member 12. Slot 46 penetrates movable holding member 12 to any depth necessary to sufficiently receive needle 15. Slot 46 may partially penetrate movable holding member 12, as demonstrated in FIG. 1 by the dotted lines, thereby allowing needle 15 to penetrate movable holding member 12 from the distal side to a certain predetermined depth that sufficiently allows slot 46 to receive and retain needle 15. In this instance, movable holding member 12 vertically supports needle 15 within slot 46. Alternatively, slot 46 may completely penetrate movable holding member 12 and pass through to the bottom or proximal side of movable holding member 12 thereby allowing needle 15 to pass through movable holding member 12 entirely. In embodiments such as these, needle 15 may be vertically supported by vertical support member 24 or inwardly disposed flange 34 of vertical support member 24 (see FIGS. 2-5).

Figure 1:
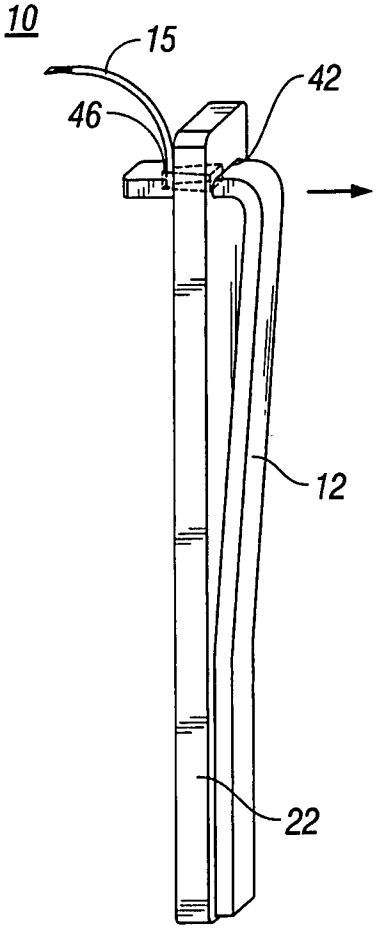
FIG. 1 is a perspective view of a needle holder in a needle holding position.

As shown in FIG. 1, needle holder 10 includes fixed support member 22 and movable holding member 12 in the needle holding position. Needle 15 is received by slot 46 and is vertically supported by movable holding member 12. In the needle holding position, fixed support member 22 provides frictional support to retain needle 15 in a fixed reproducible position for manufacturing needles in bulk.

Now turning to FIGS. 2-7, needle holder 10 as described herein may include fixed support member 22, movable holding member 12 and vertical support member 24.

Figure 2:
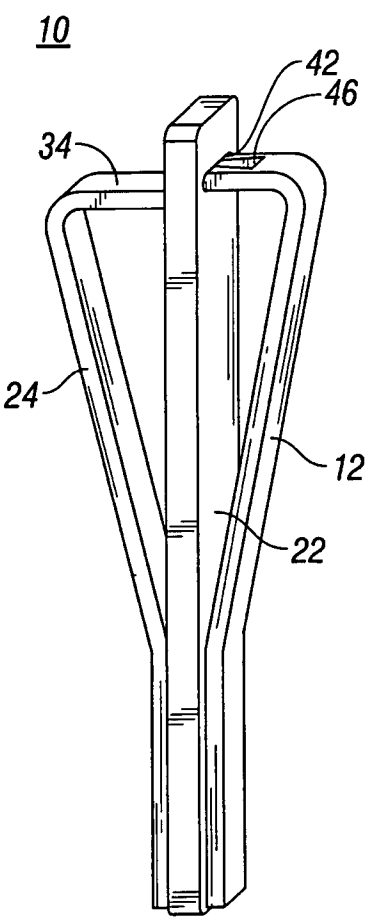
FIG. 2 is a perspective view of a needle holder in a normally biased position.

In FIG. 2, needle holder 10 is shown in a normally biased configuration with flange 34 of vertical support member 24 located on one side of fixed support member 22 and movable holding member 12 located on the other side of fixed support member 22. As shown, movable holding member 12 is interleaved with inwardly disposed flange 34 of vertical support member 24 to allow relative movement of movable holding member 12 to vertical support member 24. Flange 34 of vertical support member 24 is shown in abutting relationship with fixed support member 22 at some point proximal aperture 42. Flange 34 of vertical support member 24 is positioned to provide vertical support to needle 15 after passing entirely through slot 46 of movable holding member 12. Movable holding member 12 is shown in alignment with aperture 42 on fixed support member 22.

As shown in FIG. 3, when an inward force is applied to movable holding member 12 towards fixed support member 22 and vertical support member 24, movable holding member 12 will penetrate and pass through aperture 42 on fixed support member 22. In addition, slot 46 on movable holding member 12 will partially or completely penetrate and pass through aperture 42 on fixed support member 22. Since flange 34 and movable holding member 12 are interleaved, some portion of movable holding member 12 and slot 46 will pass through aperture 42 and directly overlay flange 34, which as previously stated is in abutting relationship with fixed support member 22 below aperture 42.

Figure 4:
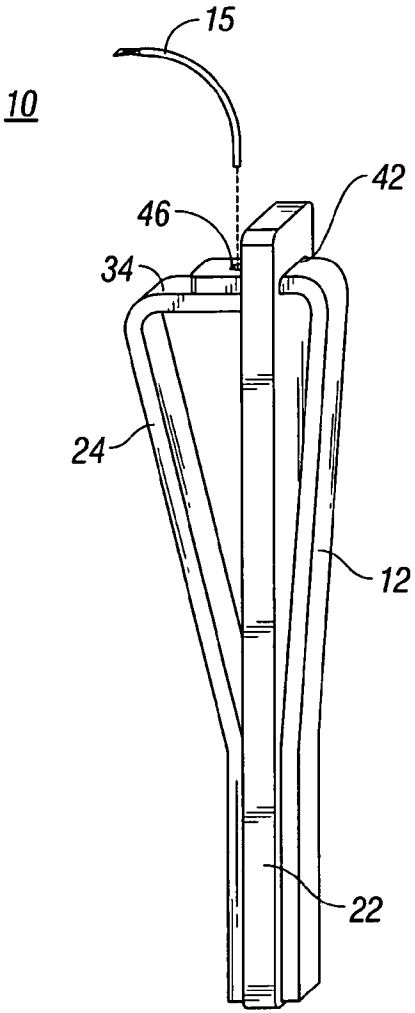
FIG. 4 is a perspective view of a needle holder in a needle receiving position with an inward force applied to the movable holding member and a needle being situated in the slot located on the movable holding member.

Now turning to FIG. 4, needle holder 10 is shown in a needle receiving position which enables receipt of needle blank 15 within slot 46 while the inwardly applied force is maintained against movable holding member 12. Slot 46 is configured to receive a variety of different needles 15 and may be of any shape and size. More specifically, slot 46 may be octagonal, triangular, round, square or rectangular to match a specific needle shape during the manufacturing process thereby enhancing the ability of slot 46 to receive and retain needle 15 in a fixed reproducible position (See FIG. 9). Since slot 46 directly overlays flange 34, needle 15 can be supported vertically by flange 34 of vertical support member 24 while being situated within slot 46.

Figure 5:
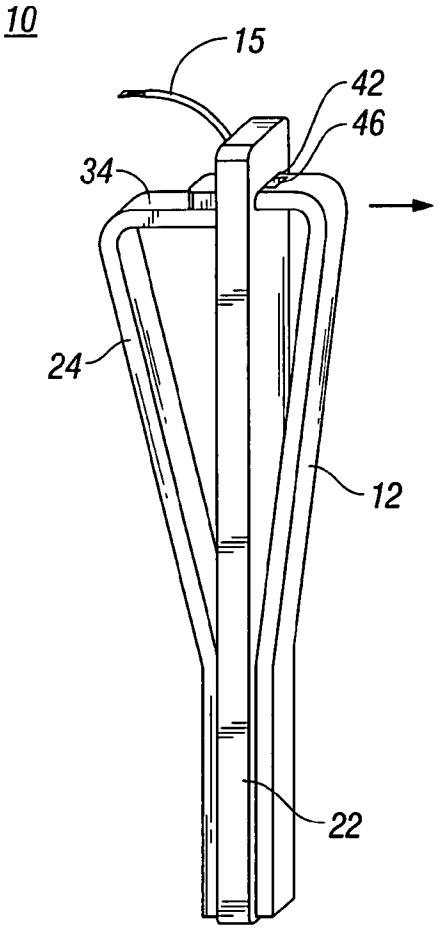
FIG. 5 is a perspective view of a needle holder in a needle holding position wherein a needle is held in position after an inward force is removed or lessened from the movable holding member.

Once needle 15 has been properly situated, the inwardly directed force applied to movable holding member 12 may be removed or lessened to the degree which allows movable holding member 12 to move outwardly away from fixed support member 22 and vertical support member 24. Movable holding member 12 will move outwardly away from fixed support member 22 while slot 46 begins to partially withdraw from aperture 42. However, since needle 15 is situated within slot 46 and fixed support member 22 extends distally from aperture 42, needle 15 will become frictionally supported by fixed support member 22 preventing movable holding member 12 and slot 46 from completely withdrawing from aperture 42, as seen in FIG. 5. In this needle holding position, the frictional support provided by fixed support member 22 will hold needle 15 in a fixed reproducible position for manufacturing needles in bulk.

Figure 7:
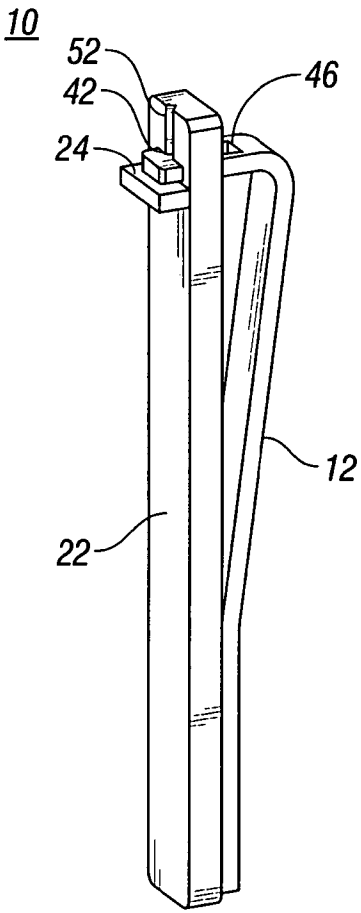
FIG. 7 is a side view of a needle holder in a normally biased position showing the fixed support member having a notch and an alternative embodiment for the vertical support member.
Figure 6:
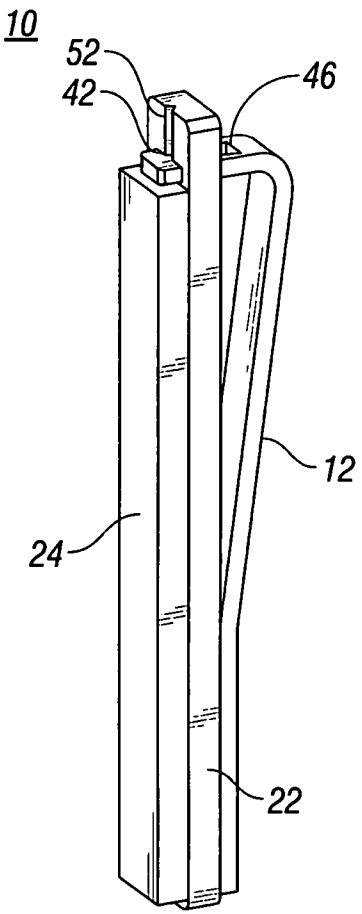
FIG. 6 is a side view of a needle holder in a normally biased position showing the fixed support member having a notch and an alternative embodiment for the vertical support member.

In another embodiment, fixed support member 22 may further include notch 52 which extends in a distal direction on fixed support member 22 from aperture 42 (See FIGS. 6-7). Notch 52 can be of any shape, size or depth necessary to enhance the ability of fixed support member 22 to receive and retain needle 15 in a fixed reproducible position for bulk manufacturing.

In FIGS. 6 and 7, needle holder 10 is shown in side view. In FIG. 6, needle holder 10 is shown in a normally biased configuration wherein movable holding member 12 partially penetrates aperture 42 of fixed support member 22. In alternative embodiments, vertical support member 24 may extend vertically substantially the entire length and width of fixed support member 22 to aperture 42. It is envisioned that vertical support member 24 can extend vertically in the proximal direction to aperture 42 any length and/or width, including from about substantially the entire length and width of fixed support member 22 to a small shelf or tab (see FIG. 7) that is limited in size and shape to vertically support a single needle 15.

As shown in FIGS. 6 and 7, notch 52 may be triangularly configured to receive a triangular shaped needle 15 thereby enhancing the ability of needle holder 10 to retain triangular shaped needles 15. It is envisioned that notch 52 can be configured to receive a variety of different shape needles, i.e., octagonal, circular, hexagonal, rectangular, curved, straight, etc. In addition, notch 52 may extend distally from aperture 42 any length of distance sufficient to enhance the ability of fixed support member 22 to frictionally support needle 15 in a fixed reproducible position.

Figure 8:
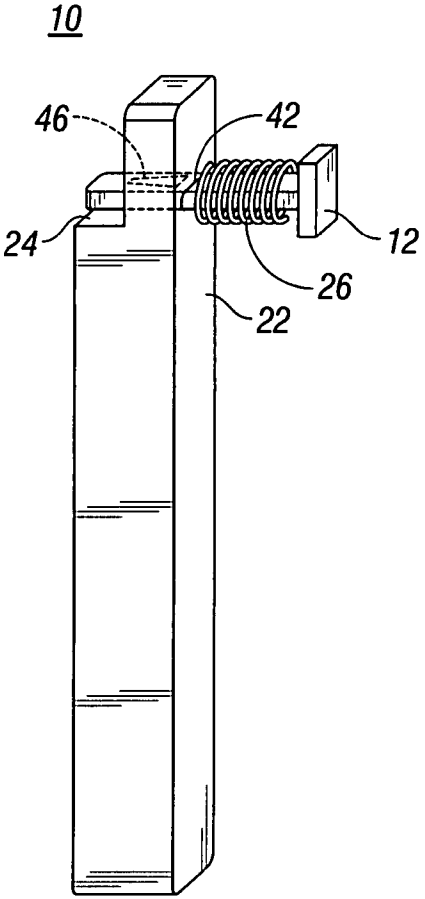
FIG. 8 is a perspective view of a needle holder in a normally biased position showing the biasing member as a spring or spring-like structure.

In still another embodiment, movable holding member 12 may not be biasable and therefore may require the assistance of a biasing member 26 to move between the first needle receiving position which enables receipt of said needle blank within said slot and the second needle locking position. Any structure which biases movable holding member 12 in an outwardly direction away from fixed support member 22 thereby holding needle 15 received within slot 46 of movable holding member 12 in a fixed reproducible position may be used. As shown in FIG. 8, biasing member 26 may be a spring, or spring-like structure which biases movable holding member 12 in an outwardly direction away from fixed support member 22 thereby holding a needle 15 received within slot 46 of movable holding member 12 in a fixed reproducible position. In other embodiments, biasing member 26 may be a cantilever or a flexible arm mounted to fixed support member 22 and connected to movable holding member 12.

Also shown in FIG. 8, vertical support member 24 can alternatively be formed as part of fixed support member 22. In this alternative embodiment, fixed support member 22 may be formed to include a shelf or an edge that is located proximal to aperture 42 which is configured to vertically support needle 15 after passing through slot 46 of movable holding member 12. It is also envisioned that slot 46 of movable holding member 12 could be closed at a predetermined depth thus obviating the need for a shelf or edge. This embodiment would be similar to that shown in FIG. 1 above.

Figure 9:
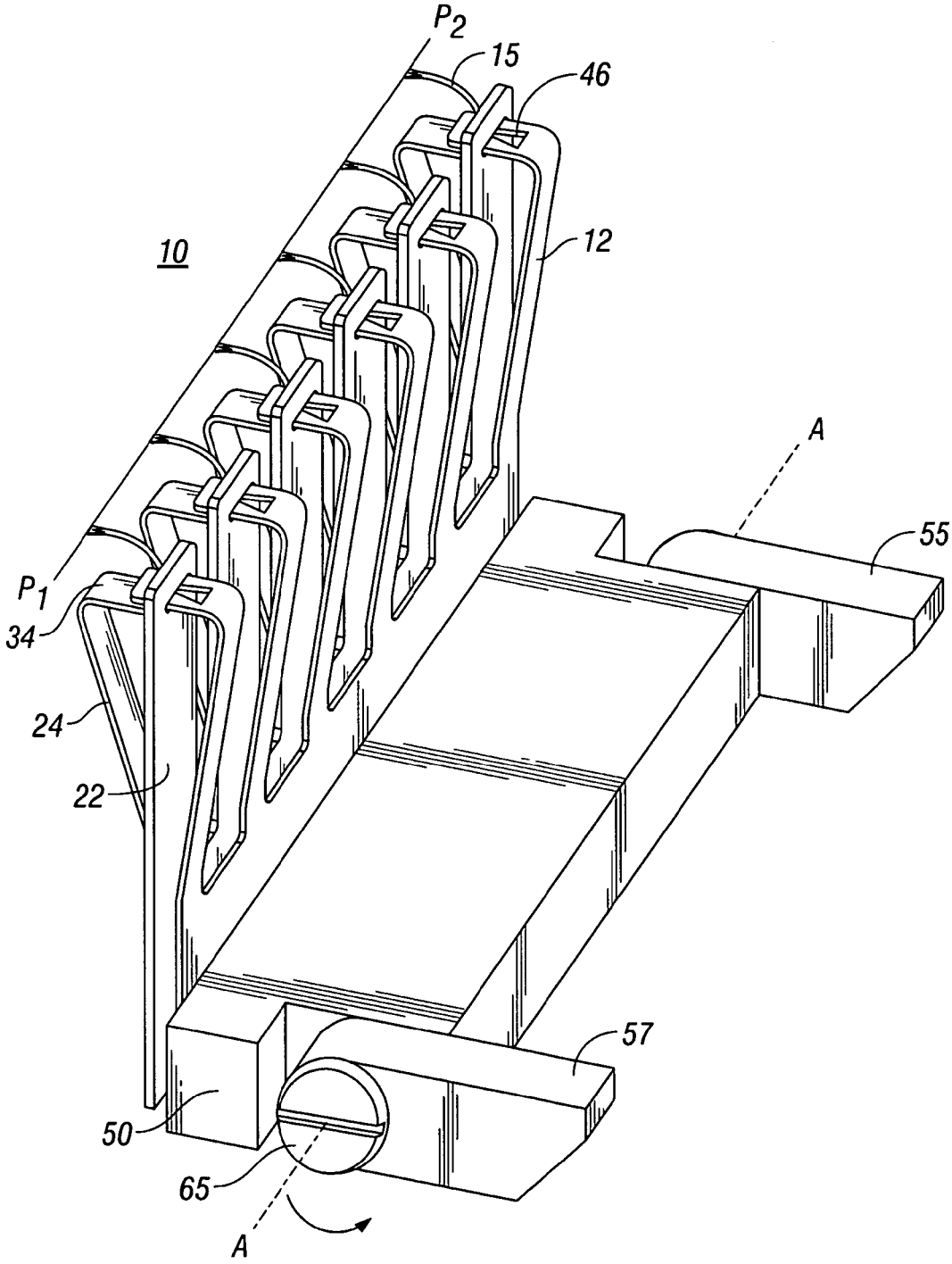
FIG. 9 is a perspective view of an array of needle holders in horizontal alignment attached to a pivotable base.
Figure 10:
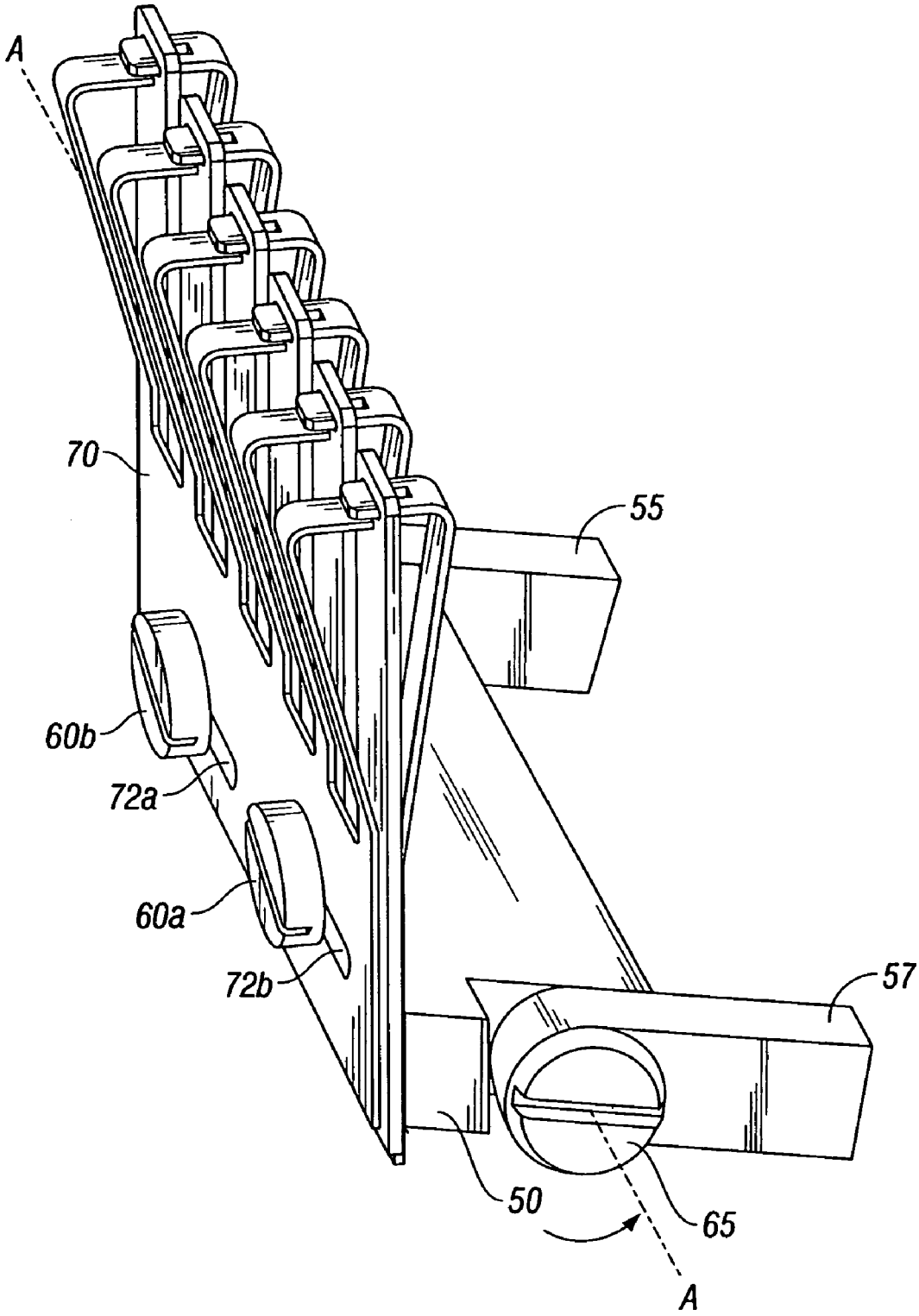
FIG. 10 is a side view of an array of needle holders in horizontal alignment attached to a pivotable base.

Referring now to FIGS. 9-10, a needle holder 10 is shown that includes an array of holders horizontally aligned in the same plane, wherein each holder includes a fixed support member, a movable holding member, and a vertical support member. Although six holders are shown, any number of holders my may be horizontally aligned in the same plane to manufacture needles in a batch process. Each individual holder includes fixed support member 22, movable holding member 12, and vertical support member 24 as presently described herein.

This horizontal alignment allows needle holder 10 to situate and hold a plurality of needles 15 in the same plane (see line $P_1$-$P_2$) which in turn allows needle holder 10 of the present disclosure to be used to manufacture, process or finish needles in similar manners without allowing the needles to make contact with each other. Furthermore, this horizontal alignment allows for a more precise ability to treat, manufacture or finish certain parts of a needle without affecting other parts of the needle. Additionally, this separation of each individual needle from other individual needles during the manufacturing or finishing process significantly decreases the wear and tear on the needles and allows for a more common result in all the needles.

Needle holder 10 can be mounted on base 50 and includes a lower plate structure 70 for abutting base 50. In some embodiments, base 50 is connected to support arms 55 and 57 by a pivotable member 65. To improve the angle at which the needle blanks are manufactured and/or to accommodate needles of different dimensions, base 50 may pivot about pivotable member 65 and around axis-A (See FIG. 9). Pivotable member 65 may be any device suitable to connecting base 50 to support arms 55 and 57 while allowing base 50 to pivot. Some examples include, but are not limited to bolts, rivots, tacks, and pins.

As shown in FIG. 10, lower plate structure 70 may include slits 72*a* and 72*b* which are defined therein to allow securing members 60*a* and 60*b* to pass through lower plate structure 70 and connect to base 50 thereby mounting needle holder 10 to base 50. Slits 72*a* and 72*b* as shown allow lower plate structure 70 of needle holder 10 to pivot in a horizontal manner parallel to axis-A. It is envisioned that slits 72*a* and 72*b* may be defined within lower plate structure 70 of needle holder 10 in any shape, dimension, size, and depth that may allow lower plate structure 70 of needle holder 10 to pivot in all directions from base 50. In addition to pivoting in a horizontal manner parallel to axis-A, it is envisioned that lower plate structure 70 of needle holder 10 may pivot in a vertical manner from base 50, as well as a horizontal manner perpendicular to axis-A, and any combination thereof.

Needle holder 10 is shown mounted to base 50 by securing members 60*a* and 60*b*. It is envisioned that at least one securing member may be used to mount needle holder 10 to base 50. In some embodiments, a plurality of securing members may be used to mount needle holder 10 to base 50. Securing members 60*a* and 60*b* may be any device suitable for mounting needle holder 10 to base 50. One specific example includes screws 60*a* and 60*b*. Some other examples include bolts, pins, nails, straps, adhesives, cables, springs, and combinations thereof.

In some embodiments, base 50, support arms 55 and 57, securing members 60*a* and 60*b*, pivotable member 65 and lower plate structure 70 and any combination thereof may be made of a conductive material such as steel or other conductive metal alloys. Examples of suitable conductive materials include, but are not limited to, metals and alloys based on titanium (e.g., nitinol, nickel titanium alloys, thermo-memory alloy materials), copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium, stainless steel, platinum, tantalum, and nickel-chrome alloys.

In one embodiment, needle holder 10 is a monolithic structure wherein fixed support member 22, movable holding member 12, and optionally vertical support member 24 are formed from one piece of material. The material may be any material strong enough to secure and hold needles 15. Particularly useful materials include conductive materials such as steel and other metal alloys. Examples of suitable conductive materials include, but are not limited to, metals and alloys based on titanium (e.g., nitinol, nickel titanium alloys, thermo-memory alloy materials), copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium, stainless steel, platinum, tantalum, and nickel-chrome alloys.

In another embodiment, needle holder 10 is not a monolithic structure wherein fixed support member 22, movable holding member 12, and optionally vertical support member 24 are not formed from a single piece of material. Rather each individual member 22, 24, and 12 is formed separately from any material strong enough to secure and hold needles 15. The separate individual members 22, 24, and 12 may be formed and held together by securing members such as screws 60*a* and 60*b*. In particularly useful embodiments, at least on of the members of the needle holder 10 are made from a conductive material such as steel or other metal alloys. Examples of suitable conductive materials include, but are not limited to, metals and alloys based on titanium (e.g., nitinol, nickel titanium alloys, thermo-memory alloy materials), copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium, stainless steel, platinum, tantalum, and nickel-chrome alloys.

In still another embodiment, not shown, an array of fixed support members 22 may be horizontally aligned in the same plane, however, each of the respective movable holding members 12, and vertical support members 24 may not be in the same plane with one another. Rather the movable holding members 12, and the vertical support members 24 may alternate sides of the fixed support members 22 as they proceed down the line of the needle holder 10. This would allow alternating sets of fixed support members 22, movable holding members 12, and vertical support members 24 to hold needles 15 in opposite directions extending outwardly from fixed support members 22. Although needles 15 would be facing in opposite directions in alternating fashion, every other needle 15 would be in horizontal alignment. Instead of one line of alignment as shown in FIG. 9 ($P_1$-$P_2$) this type of needle holder 10 may have two lines of horizontal alignment wherein one line is on each side of fixed support members 22.

The needle holders 10 described herein are particularly useful in manufacturing surgical needles using a grindless process as described in commonly-owned U.S. Patent Application No. 2005/0044922, the entire contents of which is herein incorporated by reference. The grindless process involves the needle being pressed a multiple of times to form the future cutting edges of the needle. Along the future cutting edges remains pressed excess needle material called "flash". Once the needle is pressed into shape, the needle with flash is submerged into an acid bath and exposed to different levels of energy for different lengths of time. By maintaining the more than one needle in horizontal alignment, a multitude of the needles can be dipped into the acid bath and exposed to the different levels of energy for exactly the precise amount of time as needed. Additionally, only the parts of the needle that contain the flash need to be exposed to the acid bath therefore other parts of the needles are not affected by the exposure nor are they weakened by it. Also, these separated needles do not make contact with one another thereby diminishing wear and tear on the needles during the etching process.

In addition, all or a portion thereof of needle holder 10 as described herein may be treated using any suitable means to improve the electrical contact between needle holder 10, needle 15, and/or any structure onto which the holder may be placed or mounted. In embodiments, all or a portion thereof of needle holder 10 may be coated or plated with metallic materials. Examples of suitable metallic materials include, but are not limited to, metals and alloys based on titanium (e.g., nitinol, nickel titanium alloys, thermo-memory alloy materials), copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium, stainless steel, platinum, tantalum, and nickel-chrome alloys.

It is well understood that various modifications may be made to the embodiments disclosed herein. Therefore, the above description should not be construed as limiting, but merely as exemplifications of particularly useful embodiments. Those skilled in the art will envision other modifications within the scope and spirit of the claims appended hereto.

We claim:

1. A needle holder comprising:

a fixed support member defining an aperture therethrough;

a movable holding member having a first portion defining a slot for receiving at least a portion of a needle blank therein and a second portion mounted to said fixed support member in cantilevered fashion to facilitate movement of the first portion of the movable holding member through said aperture to expose said slot for receiving said needle blank; and said movable holding member being movable between a first needle blank receiving position which enables receipt of said needle blank within said slot and a second needle blank holding position wherein the first portion of the movable holding member is positioned such that the needle blank is held against said fixed support member.

2. The needle holder of claim 1 further comprising a vertical support member in abutting relationship with said fixed support member proximal to said aperture for vertically supporting said needle blank.

3. The needle holder of claim 2 wherein said vertical support member further comprises an inwardly disposed flange wherein said inwardly disposed flange of said vertical support member is interleaved with said movable holding member to allow relative movement of said movable holding member to said vertical support member.

4. The needle holder of claim 1 further comprising a biasing member which biases said movable holding member in said second needle holding position.

5. The needle holder of claim 4 wherein said biasing member includes at least one of a spring and a flexible arm.

6. The needle holder of claim 1 wherein said fixed support member further comprises a notch extending distally from said aperture on said fixed support member.

7. A needle holder array comprising:

a plurality of needle holders horizontally aligned in the same plane, each holder comprising a fixed support member and a movable holding member;

each of said fixed support members defining an aperture dimensioned and configured to receive at least a portion of said movable holding member;

each of said movable holding members having a first end including a slot dimensioned and configured for receiving at least a portion of a needle blank, each said movable holding member having a second end fixedly mounted to said fixed support member such that said slot is positioned at least partially within and movable through said aperture to expose said slot for receiving said needle blank; and said movable holding member being movable between a first needle blank receiving position which enables receipt of said needle blank within said slot and a second needle blank holding position wherein the needle blank is held against said fixed support member.

8. The needle holder array of claim 7 wherein at least one fixed support member further comprises a vertical support member in abutting relationship with said fixed support member proximal to said aperture for vertically supporting said needle.

9. The needle holder array of claim 8 wherein said vertical support member further comprises an inwardly disposed flange wherein the inwardly disposed flange of said vertical support member is interleaved with said movable holding flexible member to allow relative movement of said movable holding member to said vertical support member.

10. The needle holder array of claim 7 wherein at least one fixed support member further comprises a notch extending distally from said aperture on said at least one fixed support member.

11. The needle holder array of claim 7 further comprising a lower structure plate including at least one slit defined therein.

12. The needle holder array of claim 7 further comprising a base pivotably mounted to at least one needle holder.

13. A needle holder array comprising:

a plurality of needle holders horizontally aligned in the same plane, each holder comprising a fixed support member, a movable holding member, and a vertical support member;

said fixed support member defining an aperture therethrough to receive at least a portion of said movable holding member;

said movable holding member having a first end and a second end, the first end having a slot therein for receiving at least a portion of a needle blank therein, the second end of the movable holding member being fixedly mounted to said fixed support member to facilitate movement of the first end through said aperture to expose said slot for receiving said needle blank;

said movable holding member being movable between a first needle blank receiving position which enables receipt of said needle blank within said slot and a second needle blank holding position wherein the needle blank is held against said fixed support member; and said vertical support member in abutting relationship with said fixed support member proximal to the aperture for vertically supporting said needle.

14. The needle holder array of claim 13 wherein at least one fixed support member further comprises a notch extending distally from said aperture on said fixed support member.

15. A needle holder comprising:

a fixed support member having a first end and a second end, the first end defining an aperture; and a movable holding member having a first end defining a slot and a second end secured to the second end of the fixed support member, the first end of the support member being movable through the aperture from a first position in which the slot is exposed to a second position in which the slot is positioned at least partially within the aperture, wherein the movable holding member is resiliently biased towards its second position.

16. The needle holder of claim 15 further comprising a vertical support member in abutting relationship with said fixed support member proximal to said aperture for vertically supporting said needle blank.

17. The needle holder of claim 16 wherein said vertical support member further comprises an inwardly disposed flange wherein said inwardly disposed flange of said vertical support member is interleaved with said movable holding member to allow relative movement of said movable holding member to said vertical support member.

18. The needle holder of claim 15 wherein said fixed support member further comprises a notch extending distally from said aperture on said fixed support member.

* * * * *